United States Patent [19]

Walker, Jr.

[11] 4,401,008

[45] Aug. 30, 1983

[54] AMMUNITION HANDLING SYSTEM

[75] Inventor: George L. Walker, Jr., Burlington, Vt.

[73] Assignee: General Electric Company, Burlington, Vt.

[21] Appl. No.: 293,817

[22] Filed: Aug. 17, 1981

[51] Int. Cl.[3] ..... F41D 10/14

[52] U.S. Cl. ..... 89/33 BB

[58] Field of Search ..... 89/33 R, 33 BB, 33 BC, 89/33 C, 33 CA, 33 E, 35 R, 35 A

[56] References Cited

U.S. PATENT DOCUMENTS

| | | | |
|---|---|---|---|
| 2,573,774 | 11/1951 | Sandberg | 89/34 |
| 2,710,561 | 6/1955 | Dowd | 89/34 |
| 2,851,927 | 9/1958 | Smith | 89/33 |
| 3,021,761 | 2/1962 | Tillander | 89/33 |
| 3,333,506 | 8/1967 | Henshaw et al. | 89/33 |
| 3,437,005 | 4/1969 | Trumper | 89/33 |
| 3,650,176 | 3/1972 | Lindner | 89/35 A |
| 3,766,826 | 10/1973 | Salomonsson | 89/41 B |
| 3,788,189 | 1/1974 | Sachleben, Sr. et al. | 89/34 |
| 3,901,123 | 8/1975 | Jayne et al. | 89/33 C |
| 3,974,738 | 8/1976 | Mayer | 89/34 |
| 3,995,509 | 12/1976 | Backus et al. | 74/413 |
| 4,004,490 | 1/1977 | Dix et al. | 89/33 D |

FOREIGN PATENT DOCUMENTS

| | | | |
|---|---|---|---|
| 355767 | of 1931 | United Kingdom | 89/33 BB |

OTHER PUBLICATIONS

"The Gatling Gun", by Wahl and Toppel, Arco Publishing Co. Inc., New York, 1965, p. 161.

H. C. Foshag Designed System Used With the 20 mm Towed Vulcan Air Defense System.

*Primary Examiner*—Stephen C. Bentley

*Attorney, Agent, or Firm*—Bailin L. Kuch

[57] ABSTRACT

A feature of this invention is the provision of a train of rounds carriers, adapted to come from a stationary supply, each carrier coupled to the next adjacent carrier by pivot means capable of unrestricted rotation, and each carrier carrying a respective round of ammunition; and a rounds orientation means, adapted to rotate in train as a function of the rotation in train of a gun and to intercept and orient each assembly of carrier and respective round, by rotation of its respective pivot means, to an orientation in train which is determined by the orientation in train of the gun.

2 Claims, 17 Drawing Figures

AMMUNITION HANDLING SYSTEM

CROSS-REFERENCE TO RELATED APPLICATION

Subject matter disclosed, but not claimed in this application, is disclosed and claimed in Ser. No. 293,818, filed Aug. 17, 1981 by D. P. Tassie.

BACKGROUND OF THE INVENTION

1. Field of the Invention

This invention relates to an ammunition conveyor system for providing rounds of ammunition seriatim from a stationary supply to a gun in a turret which has unrestricted rotation in train.

2. Prior Art

Conventional systems for providing rounds seriatim to a gun rotating in train have been of two kinds: (1) flexible chute or link systems, shown, for example, in U.S. Pat. No. 3,437,005 issued to J. M. Trumper on Apr. 8, 1969; U.S. Pat. No. 3,650,176 issued to G. Lindner on Mar. 21, 1972; and on page 161 of "The Gatling Gun" by Wahl and Toppel, Arco Publishing Co., Inc., New York, 1965. (2) Rotary differential mechanisms, shown, for example, in U.S. Pat. No. 3,974,738 issued to E. A. Mayer on Aug. 17, 1976. Neither system type permits unlimited rotation in train. After the gun has rotated 360° more or less in one direction, it must unwind back in the other direction. If the gun is to have unlimited rotation in train, then the supply cannot be stationary, it must rotate with the gun. Some pivoting of rounds is shown in U.S. Pat. No. 3,021,761 issued Feb. 20, 1962, to F. G. Tillander and in U.S. Pat. No. 3,901,123 issued Aug. 26, 1975 to L. I. Jayne et al. While most conveyor or link systems are designed to preclude unlimited pivoting of one conveyor or link with respect to the next adjacent one, U.S. Pat. No. 2,851,927 issued Sept. 16, 1958 to W. G. Smith shows telescoped rounds fixed to lengths of flexible cable.

SUMMARY OF THE INVENTION

It is an object of this invention to provide an ammunition conveyor which will supply a train of rounds to a gun in a turret which has unrestricted rotation in train.

A feature of this invention is the provision of a train of rounds carriers, adapted to come from a stationary supply, each carrier coupled to the next adjacent carrier by pivot means capable of unrestricted rotation, and each carrier carrying a respective round of ammunition; and a rounds orientation means, adapted to rotate in train as a function of the rotation in train of a gun and to intercept and orient each assembly of carrier and respective round, by rotation of its respective pivot means, to an orientation in train which is determined by the orientation in train of the gun.

BRIEF DESCRIPTION OF THE DRAWING

These and other objects, features and advantages of this invention will be apparent from the following specification thereof taken in conjunction with the accompanying drawing in which.

DESCRIPTION OF THE INVENTION

Figure 1:
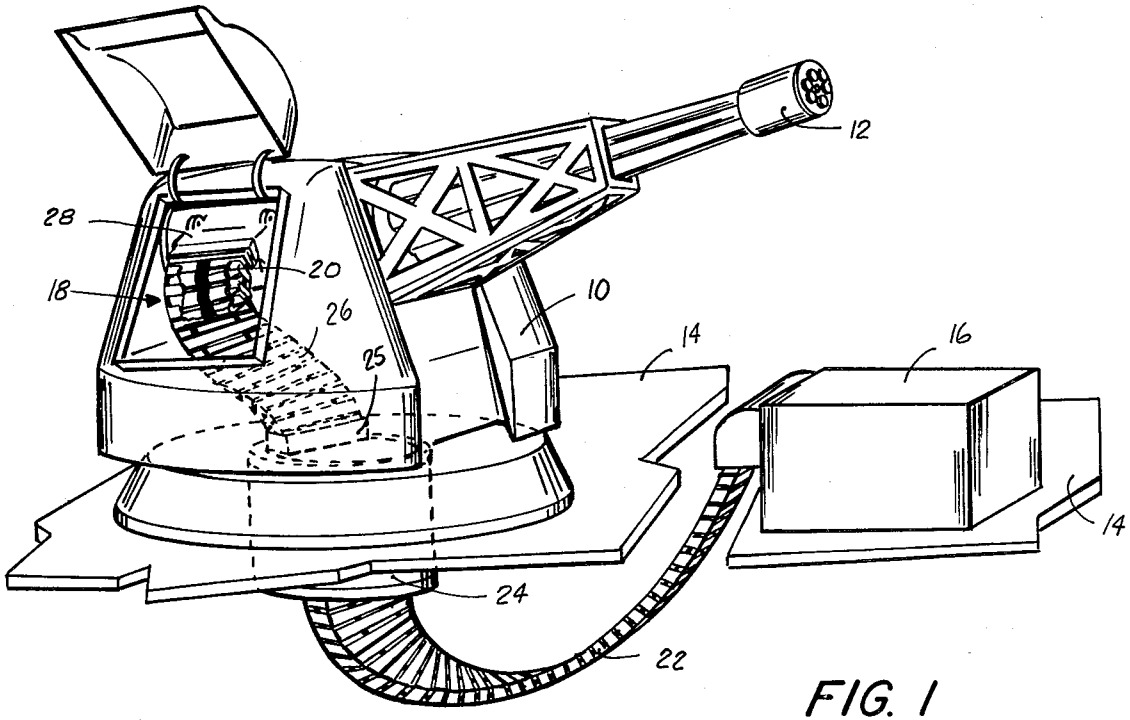
FIG. 1 is a diagrammatic showing of a gun turret system embodying this invention.

As seen in FIG. 1, the gun turret system includes a gun turret 10 having a gun 12 which is unrestricted in its rotation in train or azimuth with respect to a stationary deck 14. The turret, for example, may be of the type shown in U.S. Pat. No. 3,766,826 issued to H. M. A. Salomonsson on Oct. 23, 1973, or U.S. Pat. No. 3,995,509 issued to L. F. Backus et al on Dec. 7, 1976. Rounds of ammunition are provided to the gun from an ammunition handling system 16 which is stationary with respect to the deck. The handling system may be generally of the type shown in U.S. Pat. No. 4,004,490 issued to J. Dix et al Jan. 25, 1977, but without a return of fired cases to the storage drum, or U.S. Pat. No. 3,788,189 issued to H. G. Sachleben, Sr., et al. on Jan. 29, 1974. In the system specifically shown in FIG. 1, the supply 16 is of the type wherein a linked belt of ammunition is hung in festoons from support elements, as shown, for example, in U.S. Pat. No. 2,573,774 issued to R. N. Sandberg on Nov. 6, 1951, or U.S. Pat. No. 2,710,561 issued to A. A. Dowd on June 14, 1955, or the H. C. Foshag designed system used with the 20 mm towed vulcan air defense system. The rounds of ammunition travel from the supply to the gun in a train 18 of interconnected carriers 20. The train 18 passes through a lower chute 22 from the supply to a rounds orientation mechanism 24 and therefrom through a booster 25 and an upper chute 26 to the feeder 28 of the gun 12.

Figure 4:
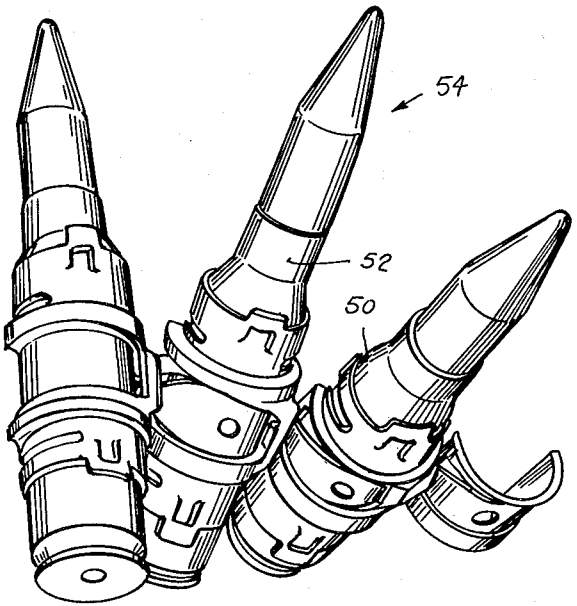
FIG. 4 is a perspective view of a train of the carrier assemblies of FIG. 2 with respective rounds of ammunition, showing unrestricted swiveling about the longitudinal axis of the train.
Figure 2:
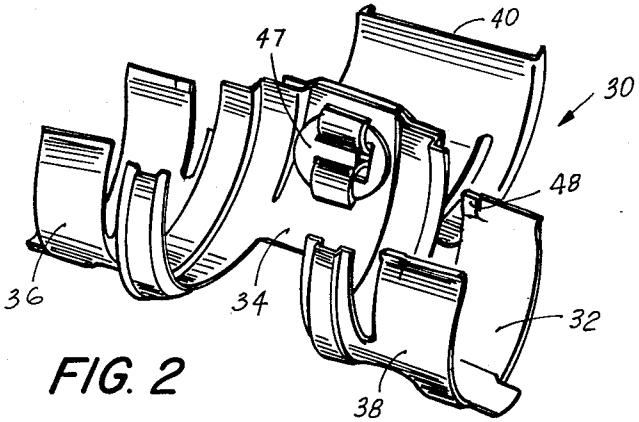
FIG. 2 is a perspective view of a carrier assembly for a round of ammunition permitting unrestricted swiveling between immediately adjacent carrier assemblies.
Figure 3:
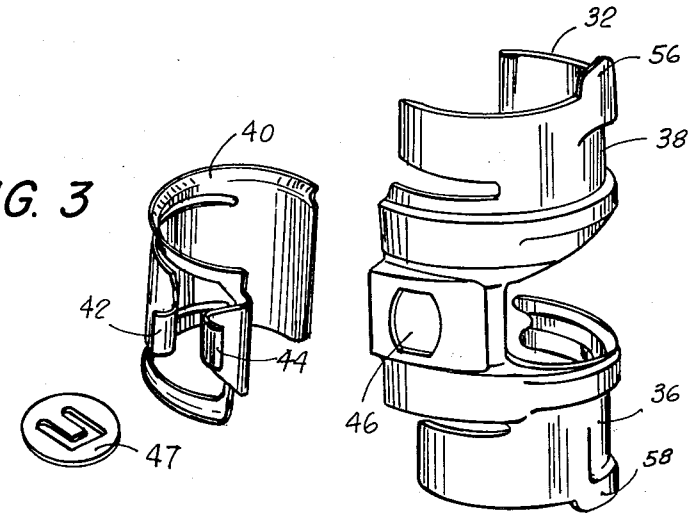
FIG. 3 is a perspective view of the carrier assembly of FIG. 2 in a disassembled state.

As seen in FIGS. 2, 3, and 4, the carriers are a modified form of a conventional link 30 such as the XM28AS-78D006-002. Each link comprises a first element 32 having a yoke shape with a central portion 34 and two distal portions 36 and 38 adapted to snap onto the cartridge case of the round. The link also comprises an element 40, adapted to snap onto the case between the portions 36 and 38 of the next succeeding link, and having two biased apart bent fingers 42 and 44 which are adapted to pass through a hole 46 in the central portion 34. A clip 47 having a "U" shaped aperture therein is adapted to engage the bent fingers to interlock the two elements 32 and 40. The hold 46 may be made substantially elliptical and the fingers substantially flat to normally align the two elements in parallel, yet permit full 360° rotation about a diameter through the cartridge case, between the two elements via the rotation of the fingers within the hole. This diameter of the case should preferably pass through the centroid of the assembly of round and clipped thereon to link elements. The link may include a special orienting element, such as a bent-in element 48 to engage an annular groove 50 in the case 52 of the round 54. The link may also include guide feet 56 and 58 adapted to ride in guide channels in the chutes 22 and 26.

Figure 6:
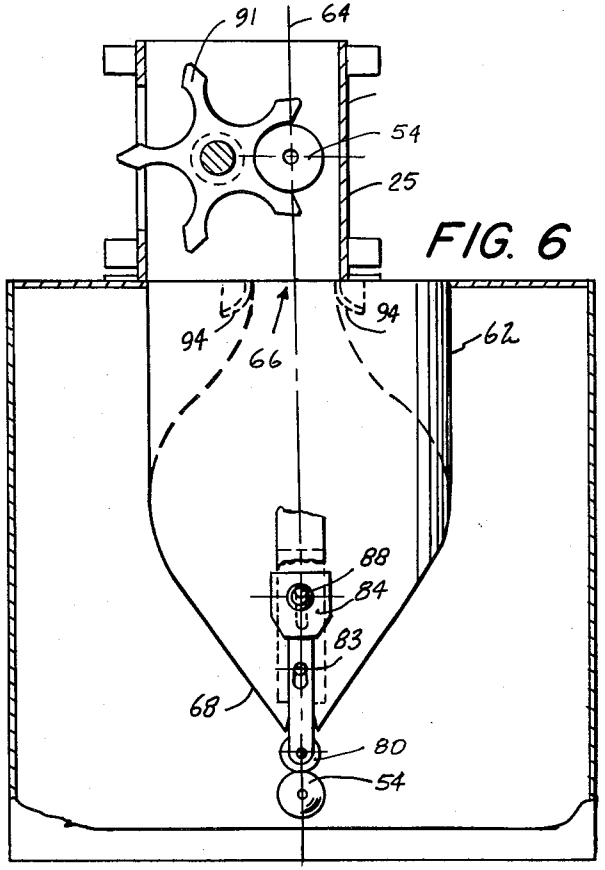
FIG. 6 is a front view in elevation of the assembly of FIG. 5.
Figure 5:
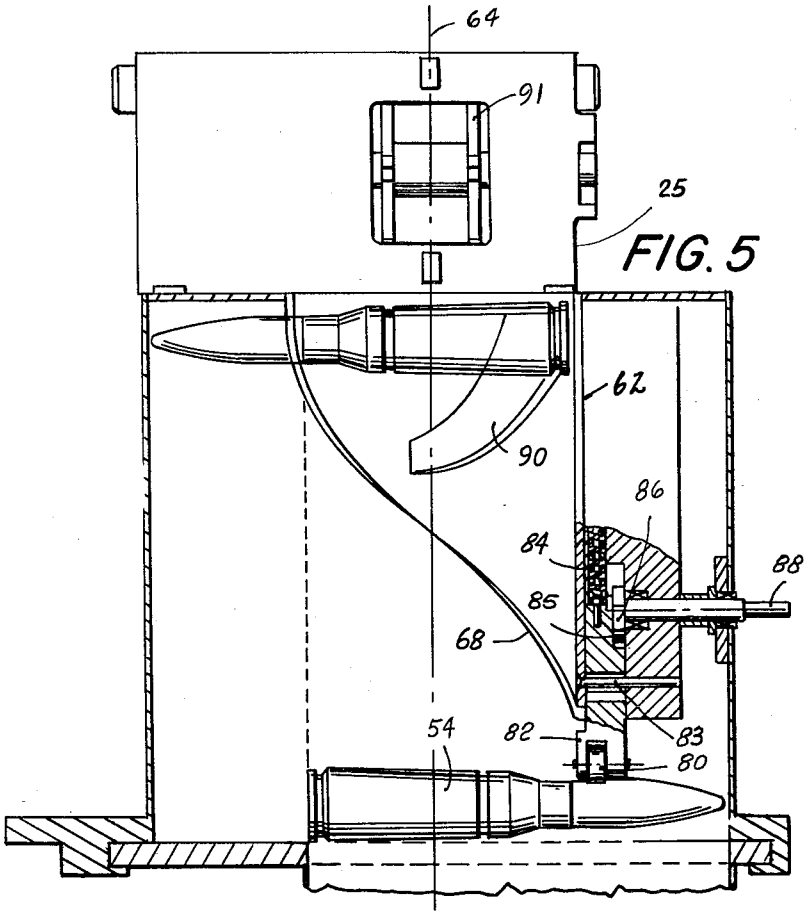
FIG. 5 is a side view in elevation of a first embodiment of the rounds orientation mechanism through which the train of carrier assemblies of FIG. 4 passes from the stationary supply to the rotating-in-train gun.
Figure 7:
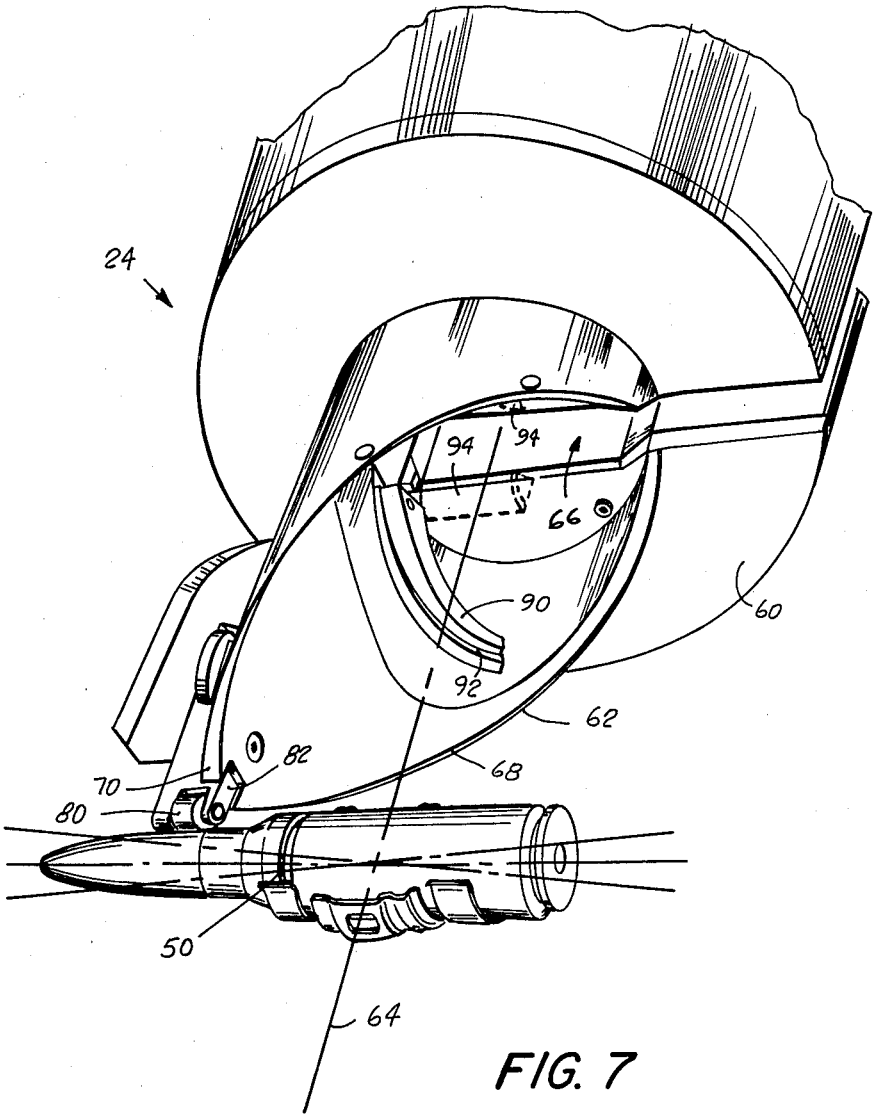
FIG. 7 is a perspective view of the orientation cam.
Figure 8:
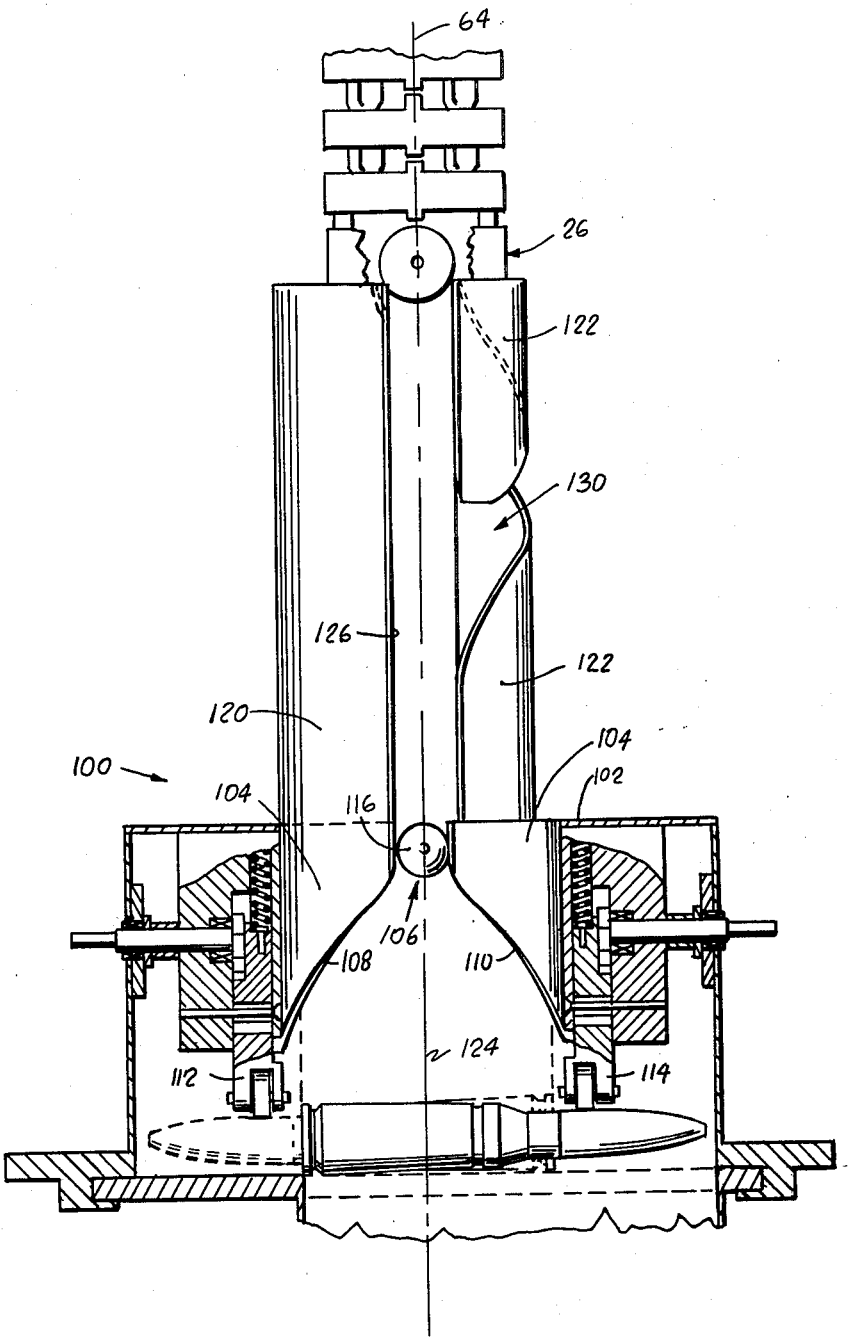
FIG. 8 is a side view in elevation of a second embodiment of the rounds orientation mechanism through which the train of carrier assemblies of FIG. 4 passes from the stationary supply to the rotating-in-train gun.
Figure 9:
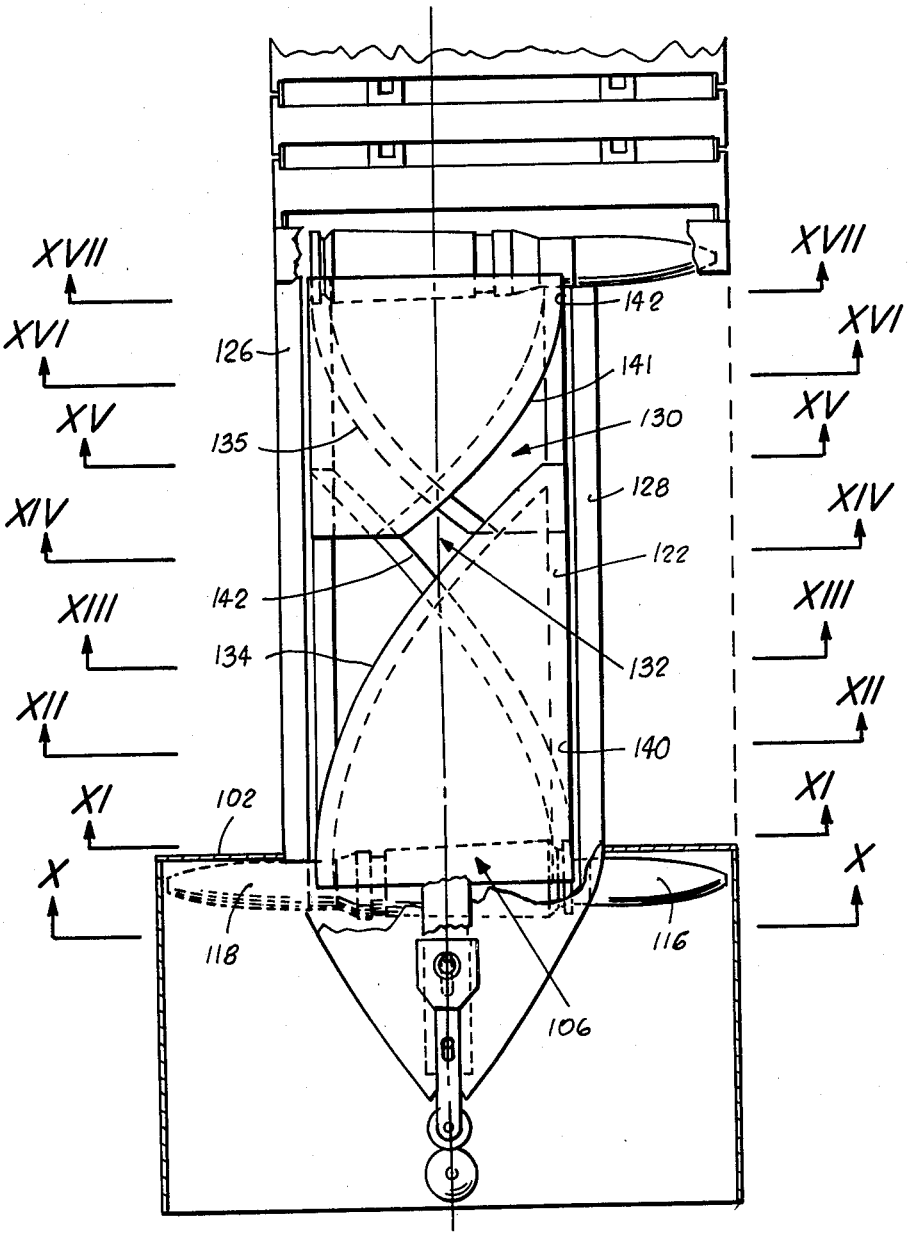
FIG. 9 is a front view in elevation of the assembly of FIG. 8.
Figure 11:
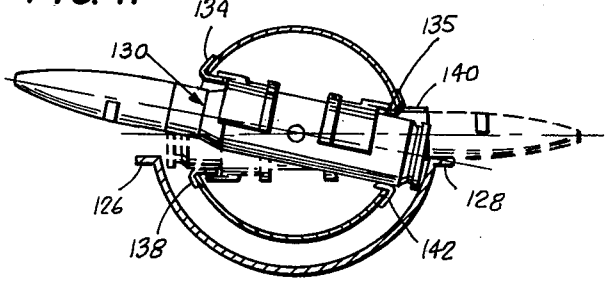
FIGS. 10 through 17 are bottom views in cross-section through the assembly of FIG. 9 taken along the planes X—X through XVII—XVII respectively.
Figure 13:
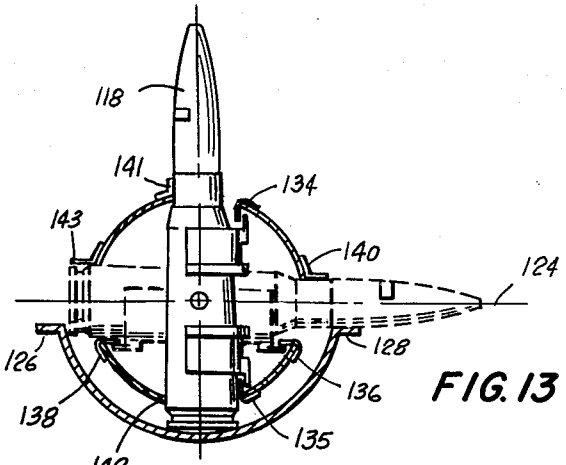
Figure 10:
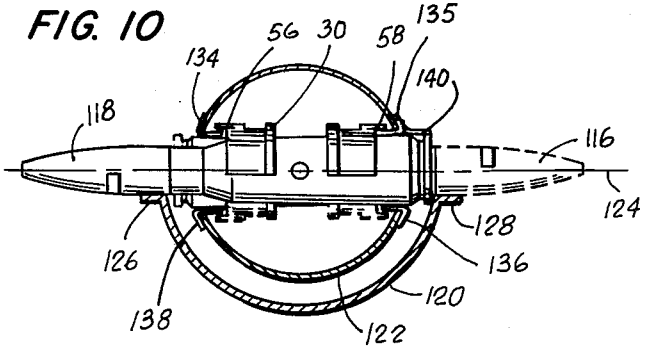
Figure 12:
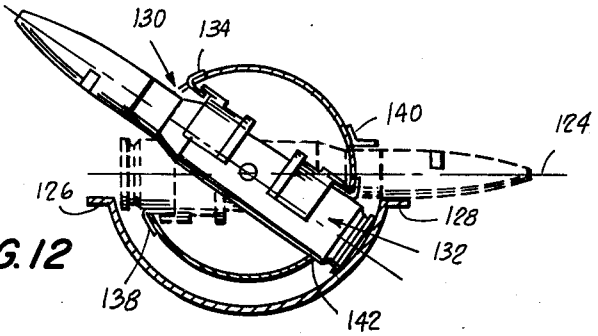
Figure 15:
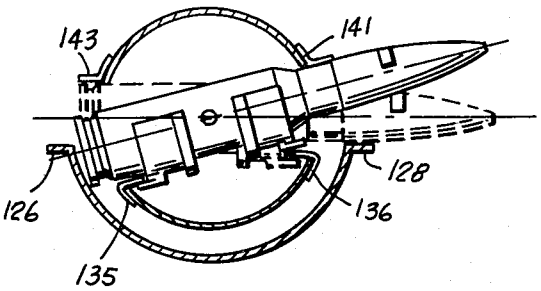
Figure 17:
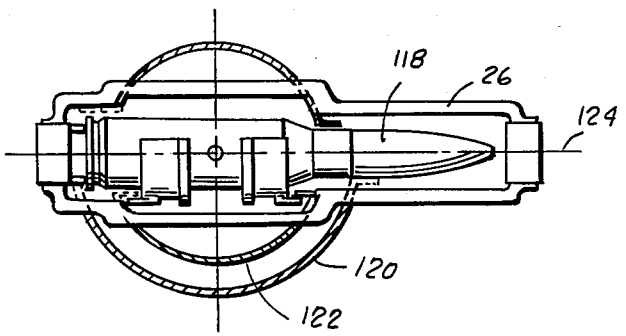
Figure 14:
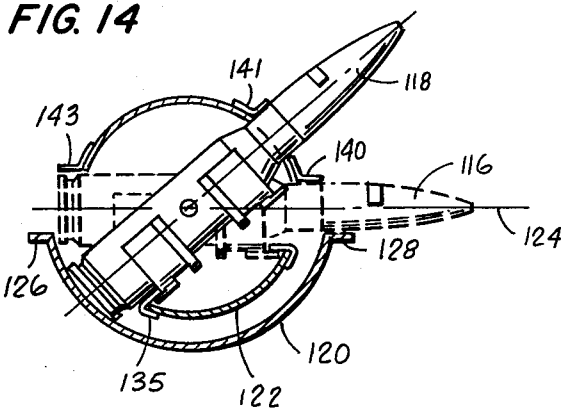
Figure 16:
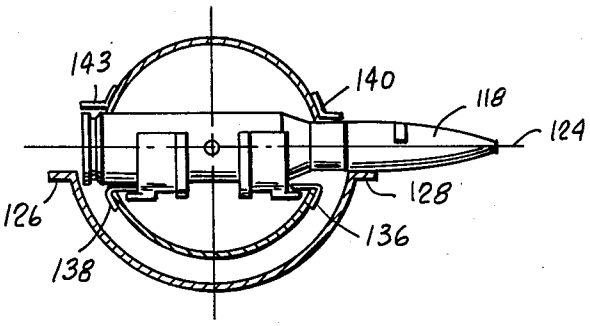

As seen in FIGS. 5, 6 and 7, the first embodiment of the rounds orientation mechanism 24 comprises a plate 60 which has fixed thereto a hollow cylinder 62 which is coaxial with the axis of rotation 64 of the turret in azimuth, and is coupled to the turret to rotate therewith. The plate has a cutout 66 therein adapted to pass a carrier assembly and a respective round of ammunition in a predetermined orientation to the axis of rotation 64. The cylinder 62 is cut at its distal end along a substantially diagonal plane, to form a symmetrical, single nose cam surface 68. The nose of the cam, the axis of rotation 64, and the longitudinal axis of the round of ammunition as it passes through the cutout 66 all lie in a common plane. The cam surface 68 is symmetrical with respect to this common plane.

A roller 80 is journaled for rotation at the end of a lever arm 82 which is mediately mounted to the cylinder 62 by a pivot 83 passing through an oversize hole in the arm. A spring 84 biases the arm downwardly against the pivot. The other end of the arm 82 has a pocket cam surface 85 which is engaged by an eccentric cam 86 fixed on a shaft 88 which is driven by suitable shafting from the turret. As the shaft 88 turn, the lever with the roller dithers to and fro a few degrees. The roller 80 serves as the actual nose of the cam surface 68, and the high point of this actual nose is in continual movement with respect to the remainder of the cam surface. The purpose of this moving nose is to preclude a round of ammunition, as it passes through the round orientation mechanism, from being perfectly aligned with the plane of symmetry, but 180° out of alignment with the cutout 66, and hanging up on the nose. The inside diameter of the cylinder 62 is made small enough that the nose engages the side of the projectile of the round, yet large enough that the base of the cartridge case clears the inner wall of the cylinder. Optionally, an additional pair of elements 90 may be fixed within the cylinder to provide respective cam surfaces 92 each adapted to engage the base, i.e., the extractor disk, of a cartridge case. In operation, as each round of ammunition is carried along into the rounds orientation mechanism, its projectile will abut the cam surface 68 and the round and its associated carrier assembly will be progressively swiveled about its respective pivots with the next succeeding and next preceding carrier assemblies. As the round approaches alignment with the cutout 66, its extractor disk will engage one or the other of the cam surfaces 92 and be guided thereby. Alternatively, the elements 90 may be omitted, and the cutout 66 may be provided with a downwardly extending bellmouth 94 to guide the base portion of the round into the cutout 66.

As the round and its carrier assembly pass through the cutout 66 they enter the booster 25 and then the upper chute 26 which leads to the loader 28 of the gun 12. The booster 25 has a sprocket 91 which assists in the pulling of the train of rounds up through the rounds orientation mechanism and third delivery into the loader. The loader has an in-feed sprocket which pulls the train of rounds into an extraction mechanism to remove each round in sequence from its carrier assembly. Each stripped round is then fed into the gun. The extraction mechanism may, for example, be of the type shown in U.S. Pat. No. 3,333,506 issued to R. W. Henshaw et al on Aug. 1, 1967.

While the embodiment here shown has had the rounds orientation mechanism acting directly upon the projectile as it is carried by its carrier, it will be appreciated that the mechanism can be made to act upon the carrier, for example, if the carrier were made longer than the round of ammunition.

As seen in FIGS. 8 through 17, the second embodiment of the rounds orientation mechanism 100 comprises a plate 102 which has fixed thereto a hollow cylinder 104 which is coaxial with the axis of rotation 64 of the turret in azimuth, and is coupled to the turret to rotate therewith. The plate 102 has a cutout 106 (similar to cutout 66) therein adapted to pass a carrier assembly and a respective round of ammunition in a predetermined orientation to the axis of rotation 64. The cylinder 104 is cut at its distal end along two, substantially diagonal, mutually intersecting planes, to form two, symmetrical, single nose cam surfaces 108 and 110. The two noses, the axis of rotation 64, and the longitudinal axis of the round of ammunition as it passes through the cutout 106 all lie in a common plane 124. Each of the cam surfaces 108 and 110 is symmetrical with respect to this common plane 124. A dithering roller assembly 112 and 114 is respectively mounted on each nose, as described with respect to the first embodiment, to preclude a round of ammunition from hanging up on the nose.

As each round is pulled up into the orientation mechanism, its projectile will engage either the cam surface 108 or the cam surface 110, and the round will be deflected up to 90° into alignment with the cutout 106 in the plate 102. However, as it passes through the cutout 106, the round will be either aligned with the chute 26 leading to the feeder of the gun or 180° out of alignment with the chute 26. A second stage orientation mechanism is fixed to and between the plate 102 and the chute 26. This mechanism comprises an outer tube 120 which is an extension of the tube 104, coaxial with the axis 64, whose interior wall just clears the base of the round, and an interior tube 122, also coaxial with the axis 64. More than the front portion of the outer tube 120 is omitted along a plane which is parallel to the plane 124 which passes through the centerline of the cutout 106. The round 116 is shown aligned with the cutout 106. The round 118 is shown 180° out of alignment with the cutout 106. The distal margins of the outer tube 120 are bent to provide two guide surfaces 126 and 128, either of which will bear on the projectile of a round which is either aligned or 180° misaligned with the cutout 106. The inner tube 122 has two helical slots 130 and 132 therein. The slot 130 is adapted to clear the diameter of the projectile of a round. The slot 132 is adapted to clear the diameter of the case of a round. The inner tube 122 has a plurality of guides fixed to its edges which bound these helical slots. Guides 134, 135, 136 and 138 are adapted to engage the feet 56 or 58 of a carrier 30, guides 140 and 141 are adapted to bear on the projectile, and guides 142 and 143 are adapted to bear on the case, all to guide a misaligned round through the helical slots, as it is pulled upwardly through the orientation mechanism, into the upper chute 26. (No booster has been shown between the orientation mechanism and the upper chute, but a booster may be provided as shown in FIG. 6). As shown in FIGS. 10 through 17, a round 118 which is 180° misaligned, is progressively rotated, as it is pulled upwardly, into alignment with upper chute 26. The upper chute 26 is aligned with the cutout 106. A round 116 which is aligned with the cutout 106 is pulled up without rotation between the guides 128 and 140.

What is claimed is:

1. An armament system comprising:

a gun adapted to rotate in train about an axis, means which is stationary in train for supplying ammunition;

orientation means, disposed between said gun and said ammunition supply means, and adapted to rotate in train as a function of the rotation in train of said gun;

a train of rounds carriers passing from said supply means, through said orientation means, to said gun, each carrier coupled to the next adjacent carrier by a pivot means capable of unrestricted rotation, and each carrier carrying a respective round of ammunition;

said orientation means intercepting and orienting each assembly of carrier and respective round by rotation of its respective pivot means to an orientation in train which is determined by the orientation in train of said gun;

said orientation means including:

support means disposed for rotation about said axis and having a cutout therein for passing therethrough a carrier with a respective round of ammunition, a hollow cylinder fixed to said support means and coaxial with said axis, and having a distal end portion cut along a substantially diagonal plane to form a symmetrical, single nose cam surface having a high portion which is 180° out of phase with said cutout and a low portion which is in phase with said cutout, whereby said cam surface intercepts the projectile of each round as it passed through said orientation means, except a round which is in phase with said cutout, and cams said intercepted round and its respective carrier about its respective pivot means into an orientation whereat they are in phase with said cutout.

2. A system according to claim 1 wherein:

said orientation means further includes:

a pair of symmetrical additional cam surfaces disposed within said cylinder, each having a high portion which is out of phase with said cutout and a low portion which is in phase with said cutout, whereby one of said pair of additional cam surfaces intercepts the base of each round as it is passed through said orientation means, except a round which is in phase with said cutout, and cams, in conjunction with said nose cam surface, said intercepted round and its respective carrier about its respective pivot means into an orientation whereat they are in phase with said cutout.

* * * * *